US005549755A

United States Patent [19]

Milovich et al.

[11] Patent Number: 5,549,755

[45] Date of Patent: Aug. 27, 1996

[54] APPARATUS FOR SUPPLYING CONDUCTIVE COATING MATERIALS INCLUDING TRANSFER UNITS HAVING A COMBINED SHUTTLE AND PUMPING DEVICE

[75] Inventors: Robert Milovich, Lorain; Ronald R. Schroeder, Amherst; William F. Parmentar, Vermilion; Julius J. Molnar, Amherst; Jack Penick, Westlake, all of Ohio

[73] Assignee: Nordson Corporation, Westlake, Ohio

[21] Appl. No.: 351,818

[22] Filed: Dec. 8, 1994

[51] Int. Cl.[6] ..... B05B 5/00

[52] U.S. Cl. ..... 118/629; 118/683; 118/684; 118/685; 118/300; 239/690; 239/694; 239/708

[58] Field of Search ..... 118/683, 684, 118/685, 629, 300; 239/690, 694, 708, 3

[56] References Cited

U.S. PATENT DOCUMENTS

| | | |
|---|---|---|
| 277,305 | 5/1883 | Maltby . |
| 482,776 | 9/1892 | Avery . |
| 648,153 | 4/1900 | Serve . |
| 1,549,332 | 8/1925 | Roberts . |
| 2,660,456 | 11/1953 | Meddock . |
| 2,811,950 | 11/1957 | Entz . |
| 2,828,610 | 4/1958 | Bruehl . |
| 2,898,130 | 8/1959 | Hansen . |
| 3,063,425 | 11/1962 | Riordan . |
| 3,104,619 | 9/1963 | Swarthout . |
| 3,240,225 | 3/1966 | Barrows . |
| 3,315,899 | 4/1967 | Quarve . |
| 3,747,850 | 7/1973 | Hastings et al. . |
| 3,818,807 | 6/1974 | Semple . |
| 3,895,748 | 7/1975 | Klingenberg . |
| 3,906,122 | 9/1975 | Krause et al. . |
| 3,929,286 | 12/1975 | Hastings et al. . |
| 3,937,400 | 2/1976 | Krause . |
| 3,971,337 | 4/1976 | Hastings . |
| 3,999,691 | 12/1976 | Doom . |
| 4,004,717 | 1/1977 | Wanke . |
| 4,017,029 | 4/1977 | Walberg . |
| 4,020,866 | 5/1977 | Wiggins . |
| 4,053,012 | 10/1977 | Farmer . |
| 4,085,892 | 4/1978 | Dalton . |
| 4,124,163 | 11/1978 | Stegmann . |
| 4,138,931 | 2/1979 | Hermann et al. . |
| 4,142,707 | 3/1979 | Bjorklund . |
| 4,275,834 | 1/1981 | Spanjersberg et al. . |
| 4,313,475 | 2/1982 | Wiggins . |
| 4,489,893 | 12/1984 | Smead . |
| 4,544,570 | 10/1985 | Plunkett et al. . |
| 4,576,359 | 3/1986 | Oetiker . |
| 4,629,119 | 12/1986 | Plunkett et al. . |
| 4,657,047 | 4/1987 | Kolibas . |
| 4,660,598 | 4/1987 | Butterfield et al. . |

(List continued on next page.)

FOREIGN PATENT DOCUMENTS

| | | |
|---|---|---|
| 0394084 | 3/1990 | European Pat. Off. . |
| 0455109 | 4/1991 | European Pat. Off. . |
| 2853347 | 12/1978 | Germany . |
| 3725172 | 7/1987 | Germany . |
| 5154638 | 11/1974 | Japan . |
| 7800307 | 1/1978 | Netherlands . |
| WO87/05832 | 10/1987 | WIPO . |
| WO88/04957 | 7/1988 | WIPO . |

*Primary Examiner*—Laura Edwards
*Attorney, Agent, or Firm*—Holland & Knight

[57] ABSTRACT

An apparatus for supplying electrically conductive coating material, such as water-based paint, includes a manifold connected to a high voltage electrostatic power supply and to one or more coating dispensers, and, a number of coating transfer units which are movable between a discharge position or station at the manifold and a filling station physically spaced from the manifold. Each of the transfer units includes a combined shuttle and pumping device which initially receives coating material at the filling station, and is then movable to the discharge station where the coating material is transferred from the pumping device, through the manifold, and then to one or more coating dispensers for deposition onto a substrate.

39 Claims, 9 Drawing Sheets

U.S. PATENT DOCUMENTS

| | | | |
|---|---|---|---|
| 4,771,729 | 9/1988 | Planert et al. . | |
| 4,785,760 | 11/1988 | Tholome | 118/323 |
| 4,792,092 | 12/1988 | Elberson et al. . | |
| 4,878,622 | 11/1989 | Jamison et al. . | |
| 4,879,137 | 11/1989 | Baker et al. . | |
| 4,932,589 | 6/1990 | Diana . | |
| 4,962,724 | 10/1990 | Prus et al. . | |
| 4,971,337 | 11/1990 | Hufford . | |
| 5,014,645 | 5/1991 | Cann et al. . | |
| 5,078,168 | 1/1992 | Konieczynski . | |
| 5,083,711 | 1/1992 | Giroux et al. | 239/690 |
| 5,094,389 | 3/1992 | Giroux et al. . | |
| 5,152,466 | 10/1992 | Matushita et al. . | |
| 5,197,676 | 3/1993 | Koniecyznski et al. . | |
| 5,221,194 | 6/1993 | Konieczynski et al. . | |
| 5,271,569 | 12/1993 | Konieczynski et al. | 239/3 |
| 5,310,120 | 5/1994 | Ehinger et al. | 239/708 |
| 5,326,031 | 7/1994 | Konieczynski | 239/708 |

FROM COATING MATERIAL SUPPLY
70
68a
FROM CONTROLLER
68b
68c
68d
68e
WATER SUPPLY
34a
34b
34c
34d
34e
56
58
48
52
10

42a
42b
42c
42d
42e
22
ELECTROSTATIC POWER SUPPLY
12a
12b
12c
12d
12e
126
128
32
16
20
30
74
26
24
18
28
76
12i
78
50
12f
12g
12h
130
12j
54
34f
34g
34h
34i
34j
66
AIR SUPPLY
60
64
42f
42g
42h
42i
42j
68f
68g
68h
68i
68j
72
CONTROLLER
62
COATING MATERIAL SUPPLY
36

FROM COATING MATERIAL SUPPLY
70
68a
FROM CONTROLLER
68b
68c
68d
68e
WATER SUPPLY
34a
34b
34c
34d
34e
56
58
48
52
10

42a
42b
42c
42d
42e
22
ELECTROSTATIC POWER SUPPLY
12a
12b
12c
12d
12e
126
128
32
16
20
30
74
26
24
18
28
50
12f
12g
12h
130
12j
12i
78
76
54
66
34f
34g
34h
34i
34j
AIR SUPPLY
60
64
42f
42g
42h
42i
42j
68f
68g
68h
68i
68j
72
CONTROLLER
62
COATING MATERIAL SUPPLY
36

FROM COATING MATERIAL SUPPLY
70
68a
FROM CONTROLLER
68b
68c
68d
68e
WATER SUPPLY
56
58
34a
34b
34c
34d
34e
10

42a
42b
42c
42d
42e
22
ELECTROSTATIC POWER SUPPLY
48
52
12a
12b
12c
12d
12e
74
126
128
32
16
20
30
26
24
18
28
76
130
78
50
12f
12g
12h
12i
12j
54
34f
34g
34h
34i
34j
66
AIR SUPPLY
60
64
42f
42g
42h
42i
42j
68f
68g
68h
68i
68j
72
CONTROLLER
62
COATING MATERIAL SUPPLY
36

FROM COATING MATERIAL SUPPLY
70
68a
FROM CONTROLLER
68b
68c
68d
68e
WATER SUPPLY
34a
34b
34c
34d
34e
56
58
48
52
10

42a
42b
42c
42d
42e
22
ELECTROSTATIC POWER SUPPLY
12a
12b
12c
12d
12e
126
128
32
16
20
30
74
26
24
18
28
76
78
50
12f
12g
12h
12i
12j
54
66
34f
34g
34h
34i
34j
AIR SUPPLY
60
64
42f
42g
42h
42i
42j
68f
68g
68h
68i
68j
72
CONTROLLER
62
COATING MATERIAL SUPPLY
36

ELECTROSTATIC POWER SUPPLY
WATER SUPPLY 20
22
56
312a
300
318
324
312b
312c
312d
322
128
128
12c
128
320
308
306
406
126
126
310
130
12b
310
12a
12d
316
314
44
304
304
302
30
TO WATER VALVE
42a
42b
42c
42d
78
ROTARY ATOMIZER
68d
68c
CONTROLLER
64
AIR SUPPLY
68b
68a
34d
34c
62
66
TO TRANSFER UNITS 12a–d
COATING MATERIAL SUPPLY
36
34b
34a

APPARATUS FOR SUPPLYING CONDUCTIVE COATING MATERIALS INCLUDING TRANSFER UNITS HAVING A COMBINED SHUTTLE AND PUMPING DEVICE

FIELD OF THE INVENTION

This invention relates to electrostatic spray coating, and, more particularly, to a method and apparatus for dispensing a number of different colored coating materials from separate sources through individual coating transfer units each including a combined shuttle and pumping unit connectable to a common manifold which communicates with one or more coating dispensers.

BACKGROUND OF THE INVENTION

The application of coating materials using electrostatic spraying techniques has been practiced in industry for many years. In these applications, the coating material is discharged in atomized form and an electrostatic charge is imparted to the atomized particles which are then directed toward a substrate maintained at a different potential to establish an electrostatic attraction for the charged atomized particles. As described in detail in U.S. Pat. Nos. 5,078,168 and 5,221,194, both owned by the assignee of this invention, the recent trend has been to shift away from the use of solvent based coating materials, e.g. varnishes, lacquers, enamels and the like, in favor of water-based coatings which reduce problems of explosiveness and toxicity associated with solvent-based coatings. Unfortunately, this switch from electrostatically spraying solvent-based coating to those of the water-based type has sharply increased the risk of electrical shock among system operators.

The problem of electrical shock from water-based coatings is addressed in U.S. Pat. Nos. 5,078,168 and 5,221,194 wherein a "voltage block" system is provided for transferring electrically conductive coating materials without the formation of a completed electrical path between the source of coating material and a high voltage electrostatic power supply. The system in U.S. Pat. No. 5,078,168, for example, comprises first and second shuttle devices which are serially connected to two large reservoir piston pumps. The first shuttle is movable between a transfer position and a neutral position with respect to a filling station which is connected to a source of electrically conductive coating material. At the filling station, the first shuttle is operative to transfer coating material from the source into the reservoir of the first pump. In the neutral position, the first shuttle is electrically isolated, i.e. physically spaced, from the filling station. The second shuttle device is movable between a transfer position wherein it interconnects the first piston pump with the second piston pump, and a neutral position wherein the two pumps are electrically isolated from one another and the second piston pump supplies coating material to one or more dispensers. Movement of the shuttles is controlled to maintain one of the shuttles in a neutral position at all times during a coating operation so that there is never a completed electrical path between the source(s) of electrically conductive coating material and the electrostatically charged coating material at the dispenser(s).

Systems of the type disclosed in U.S. Pat. Nos. 5,078,168 and 5,221,194, in which the shuttles and pumps are connected in series with one another between the source of coating material and one or more coating dispensers, have suffered to some extent from problems of inadequate pressure at the coating dispensers and pressure fluctuations within the system. These problems have been addressed in U.S. patent application Ser. No. 07/961,156, filed Oct. 15, 1992, now U.S. Pat. No. 5,326,031, entitled "Apparatus for Dispensing Conductive Coating Materials Including Color Changing Capability," which is owned by the assignee of this invention. In this system, electrically conductive coating material is transmitted from two "parallel" flow paths to one or more coating dispensers. Each flow path comprises a voltage block construction including a transfer unit having a filling station connected to the source(s) of coating material, a discharge station spaced from the filling station and a shuttle movable between and releasably coupled to the filling station and to the discharge station. Upon movement of the shuttle to the filling station of the transfer unit within one of the two flow paths, the shuttle is effective to transfer coating material from the source into the reservoir of a piston pump associated with such flow path. When the reservoir of the piston pump is filled, the shuttle moves and is coupled to the discharge station wherein a connection is made allowing the coating material to be transferred from the pump reservoir, through the discharge station of the transfer unit, and, into a valve connected to the dispensers. This valve is common to both flow paths and is effective to switch the flow of coating material to the dispensers from one flow path to the other. The operation of the system is synchronized such that when the pump of one flow path is supplying coating material to the dispensers, the pump of the other flow path is receiving coating material from the source. A voltage block is continuously maintained between the source and charged dispensers, and the dispensers can be essentially continuously supplied with coating material from one or the other of the parallel flow paths.

Both the series system and parallel system described above employ large reservoir piston pumps and connective lines or tubing to transfer the coating material to separate shuttle devices, which, in turn, communicate with the coating dispensers. While these arrangements provide an effective voltage block or discontinuous path between the source(s) of coating material and a coating dispenser(s), there are certain applications in which space considerations and color change requirements make the use of such systems impractical. For example, in automotive or other vehicle paint lines, the coating supply system must be capable of rapidly changing from one color of coating material to another, and there is a limited amount of floor space which the coating system can occupy within the production facility. The provision of separate reservoir pumps and shuttles in both of the systems described above, and the tubing required to interconnect such elements with the source(s) of coating material and coating dispensers, requires more space than is available at many automotive facilities. Additionally, switch-over from a coating material of one color to another is delayed by the presence of separate pumps and shuttles, as well as the tubing therebetween, and the control functions required to achieve such changeover can be complicated.

SUMMARY OF THE INVENTION

It is therefore among the objectives of this invention to provide a method and apparatus of supplying conductive coating material, such as water-based paint, which protects against the transmission of an electrostatic charge between a high voltage electrostatic power supply and one or more conductive coating supplies, which is compact in construction, which reduces the system elements required to transfer coating material from one or more sources to coating dispensers, which is comparatively easy to clean, and, which permits the rapid change of supply of a coating material of one color to a coating material of a different color.

These objectives are accomplished in an apparatus for supplying electrically conductive coating material, such as water-based paint, which includes a manifold connected to a high voltage electrostatic power supply and to one or more coating dispensers, and, a number of coating transfer units which are movable between a coupled, discharge position or station at the manifold and a filling station physically spaced from the manifold. Each of the transfer units includes a combined shuttle and pumping device which initially receives coating material at the filling station, and is then movable to the discharge station at the manifold where the coating material is transferred from the pumping device, through the manifold, and then to one or more coating dispensers for deposition onto a substrate.

This invention is therefore predicated upon the concept of eliminating separate reservoir pumps and shuttles found in the series and parallel coating supply systems of the type described above. Instead, the shuttles and pumping devices are combined in a single, movable coating transfer unit. At the filling station, where the coating transfer units receive different colors of coating material from separate sources, each coating transfer unit is physically spaced from the charged manifold therefore providing an effective voltage block between the electrostatic power supply and the source of coating material connected thereto. Depending upon the color of coating material desired, the shuttle and pumping device of one coating transfer unit is moved to a discharge position at the manifold where the pumping device is activated to transfer coating material of that desired color into the manifold for supply to the coating dispensers. This provides a compact and efficient means of selectively supplying coating material from a number of sources, to one or more coating dispensers, while maintaining a continuous voltage block between the electrostatic power supply and coating material sources.

In one presently preferred embodiment of this invention, each coating transfer unit comprises a shuttle connected to the piston rod of a fluid cylinder which is extendable to move the shuttle along a pair of guide rods to the discharge station at the manifold, and retractable to return the shuttle to a filling station spaced from the manifold. A pumping device is affixed to the shuttle and movable therewith. The pumping device includes a pump body having a hollow interior connected by passageways formed in the shuttle to a pair of coupling elements carried by the shuttle which are engageable with a second pair of coupling elements located at the filling station. A piston head is mounted within the hollow interior of the pumping device which is connected to one end of a pump rod whose other end mounts a coupling element externally of the pump interior. Coating material is introduced into the interior of the pumping device at the filling station through one pair of the mating coupling elements carried by the shuttle and filling station, and the other pair of coupling elements are provided to permit recirculation of the coating material from the pumping device back to the source while the shuttle and pumping device are located at the filling station.

In order to discharge coating material from a coating transfer unit, the piston rod of the associated fluid cylinder is extended to move the shuttle and pumping device from the filling station to the discharge station at the manifold. In this position, a fixed coupling element connected to the manifold mates with the coupling element at the outwardly extending end of the pump rod. Once the coupling elements of the pump rod and manifold are coupled, the force exerted by the piston rod of the fluid cylinder in a direction toward the manifold causes the pump rod and piston head within the interior of the pumping device to move in the opposite direction because the coupling element at the manifold is fixed. As a result, the coating material within the pump interior is forced into a central passageway formed in the pump rod, through the interconnected coupling elements of the pump rod and manifold, and then into the manifold itself. The manifold, in turn, supplies the coating material through separate lines to one or more coating dispensers. After the pumping device is emptied of coating material, or it is otherwise desired to terminate the coating operation, the fluid cylinder retracts its piston rod to return the shuttle and pumping device from the discharge station at the manifold to the filling station.

In an alternative embodiment of this invention, a variation of the above-described coating transfer units is provided. Each coating transfer unit of this embodiment comprises a shuttle having a hollow interior which receives a pumping device movable therein along a shaft extending through the shuttle. The shaft is formed with an inlet passageway extending from one end thereof to an outlet midway along the shaft, and a discharge passageway is also formed in the shaft having an inlet midway along the shaft and an outlet at the opposite end thereof. A coupling element is mounted to each end of the shaft. The pumping device, in turn, has a hollow interior within which a pump piston is freely movable along the shaft.

In response to the introduction of pressurized air into the interior of the shuttle on one end of the pumping device carried therein, the shuttle and pumping device are movable as a unit along guide rods to the filling station where the coupling element at one end of the shaft mates with a coupling element at the filling station. Coating material is supplied through such mating coupling elements into the inlet passageway of the shaft, and exits through the outlet thereof into the hollow interior of the pumping device. The pumping device receives coating material until its pump piston is moved to one end of the pump body.

The shuttle and pumping device are then moved to the discharge station at the manifold by pressurizing the interior of the shuttle at the opposite end of the pumping unit. This forces the shuttle and pumping device away from the filling station and into position at the discharge station where the coupling element at the opposite end of the shaft mates with a coupling element located at the discharge station and connected to the manifold. The pumping device is provided with an air inlet port in a position such that pressurization of the shuttle causing it to move to the discharge station also pressurizes the interior of the pumping device. As a result, once the coupling elements of the shaft and manifold mate with one another at the discharge station, pressurization of the interior of the pumping device forces its pump piston in a direction toward the manifold thus discharging coating material from the interior of the pumping device through the discharge passageway in the shaft. The coating material exits the shaft through the mating coupling elements at the discharge station, and is then transferred through the manifold to one or more coating dispensers. The shuttle and pumping device are returned to the filling station by again pressurizing the interior of the shuttle on the opposite end of the pumping device, i.e. opposite the air port within the pumping device, while venting the other side of the shuttle.

In the presently preferred embodiment, one or more water shuttles, each connected to a source of water, are movable into coupling engagement with the manifold after a coating operation with one color of coating material has been completed. The water shuttle functions to introduce water or other flushing liquid into the manifold, and the lines connecting the manifold to the coating dispensers, to remove coating material of one color after the completion of a coating operation in preparation for receipt of a coating material of a different color. An air valve is also connected to the manifold, and to a source of pressurized air, so that air can be introduced with the water and/or separately to assist in the cleaning operation.

The system is also provided with a water transfer unit, releasably coupled to the manifold, which is used to direct water through a separate tube within the interior of the manifold directly to the coating dispensers. This water transfer unit can be used in instances where a color change is not desired but there is some interval of time between operation of the dispensers, during which period the coating material could clog the coating dispenser and produce an unacceptable finish. This water transfer unit removes such coating material resident within the dispensers prior to resumption of a coating operation.

An important advantage of the apparatus of this invention, in both of the embodiments mentioned above, is the elimination of separate pumping devices, separate shuttles, and the tubing connected therebetween. The provision of combined shuttle and pumping devices, which are movable as a unit between the filling and discharge stations, reduces the space requirements for the overall apparatus and simplifies the cleaning operation. Further, the use of a manifold eliminates the need for color changers and provides a convenient means for applying an electrostatic charge to the coating material, e.g. by interconnecting the electrically conductive manifold with a high voltage electrostatic power supply. Additionally, the water shuttle, water transfer unit and air valve associated with the manifold provide rapid and simplified cleaning of the manifold, the lines connected to coating dispensers, and, the coating dispensers themselves.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figure 1:
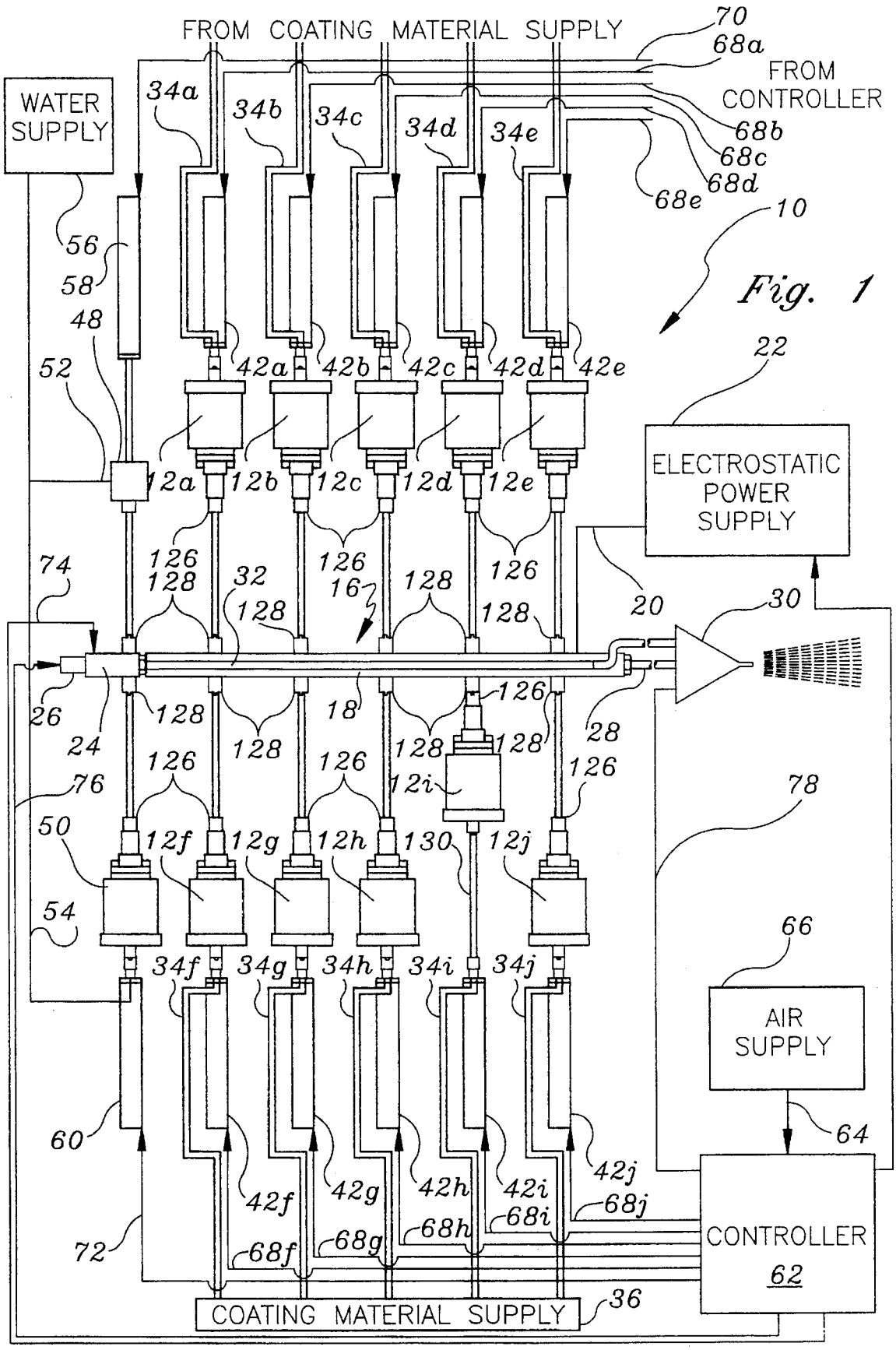
FIG. 1 is a schematic view of the overall apparatus of this invention wherein coating material of one color is being supplied to a dispenser.
Figure 2:
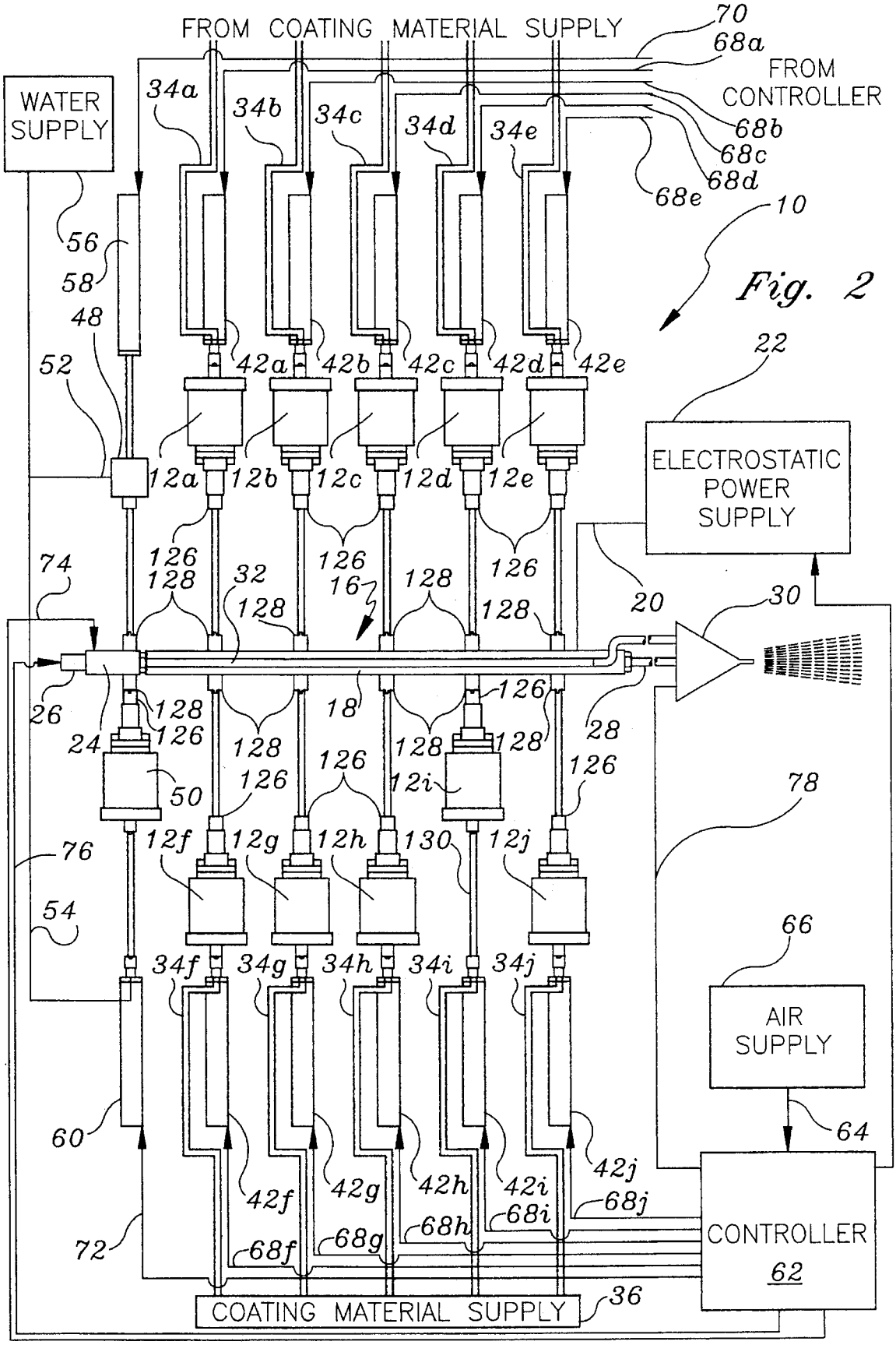
FIG. 2 is a view similar to FIG. 1 illustrating one aspect of the cleaning operation of the apparatus.
Figure 3:
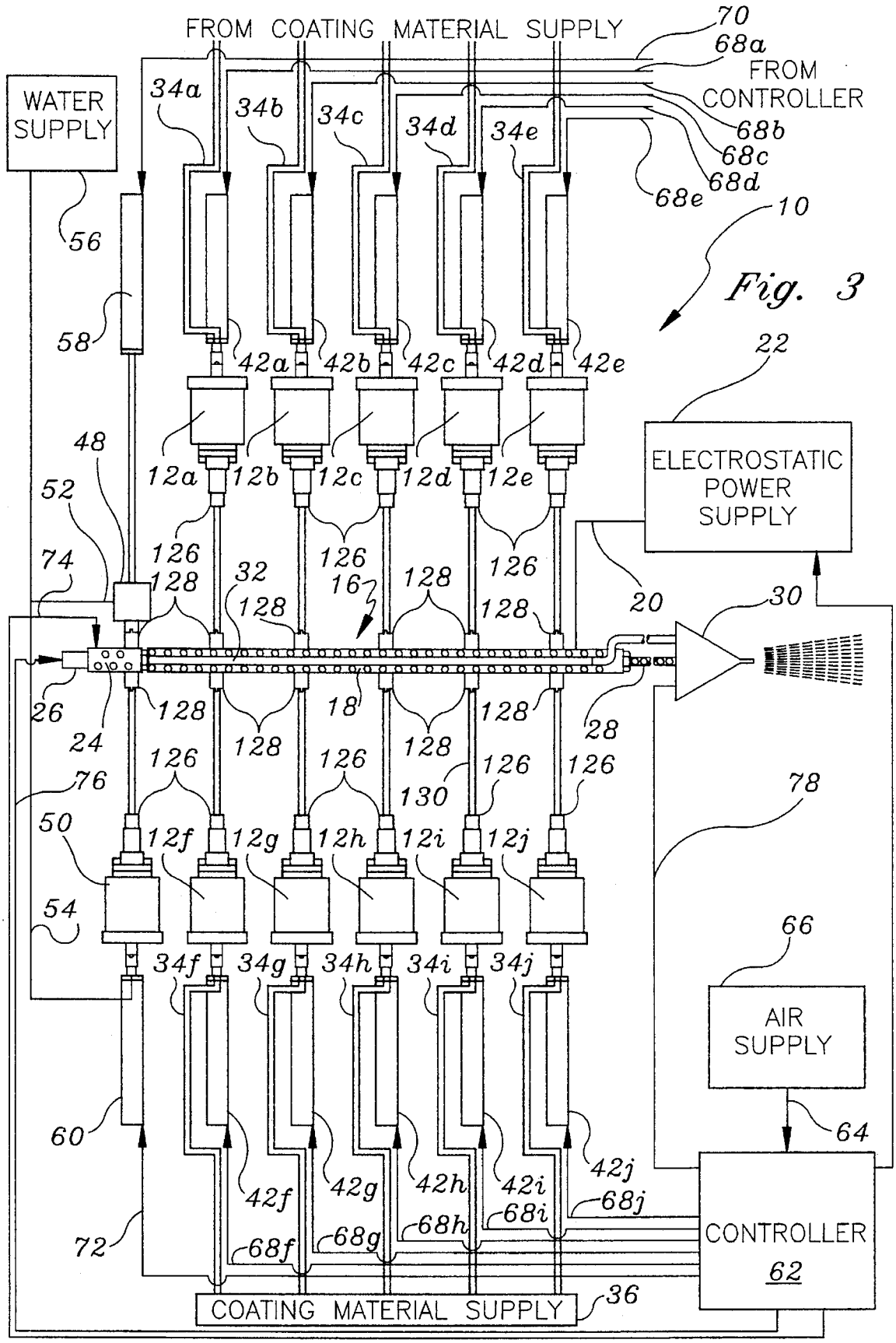
FIG. 3 is a view similar to FIG. 1 illustrating a water/air flush sequence of operation.

With reference to FIG. 1, one embodiment of the apparatus 10 of this invention is shown with a number of coating transfer units 12*a–j* schematically depicted. For purposes of the present discussion, the overall construction of apparatus 10 will be described initially, followed by a detailed description of one preferred embodiment of the transfer units 12*a–j* shown in FIGS. 5 and 6. An alternative embodiment of transfer units 14 is then described with reference to FIGS. 7 and 8. Additionally, an alternative embodiment of an apparatus 300 is described with reference to FIG. 9. Finally, the operation of apparatus 10 and 300 is described, using either the transfer units 12*a–j* or 14*a–j*, with particular reference to FIGS. 1–4 and 9.

OVERALL CONSTRUCTION OF APPARATUS 10

The apparatus 10 includes a manifold 16 which is tubular in shape and has a hollow interior 18 closed at opposite ends. Preferably, the manifold is formed of metal or other electrically conductive material which is connected by a high voltage line 20 to an electrostatic power supply 22. One end of the manifold 16 mounts a water valve 24 and an air purge valve 26. The opposite end of manifold 16 is connected by a paint supply tube 28 to one or more of coating dispensers 30. Preferably, the dispensers 30 are spray guns of the type sold by Nordson Corporation of Westlake, Ohio, the assignee of this invention, under Model No. AN-9, or rotary atomizers sold by Nordson Corporation under Model No. RA-12. Additionally, a water flush tube 32 is carried within the interior 18 of manifold 16, which is connected at one end to the water valve 24 and at the opposite end to the dispenser 30.

In the embodiment of apparatus 10 depicted in FIGS. 1–4, a total of ten transfer units 12*a–j* are shown. It should be understood that essentially any number of transfer units 12 could be employed with the apparatus 10 of this invention depending upon the requirements of a particular application. Each of the transfer units 12*a–j* are connected by a separate line 34*a–j*, respectively, to a coating material supply 36 shown schematically in FIG. 1. As better shown in FIGS. 5 and 6, and described in more detail below, the coating material supply 36 comprises a number of tanks or containers 38, each of which is filled with a coating material of different color and connected to a pump 40. These pumps 40 are connected, in turn, to a respective one of the lines 34*a–j* leading to transfer units 12*a–j*. Consequently, each transfer unit 12*a–j* has a dedicated or separate container 38 and pump 40 associated therewith so that a different colored coating material can be supplied to manifold 16 from each transfer unit 12*a–j*, as described in detail below. In the embodiment of apparatus 10 shown in FIGS. 1–6, each of the transfer units 12*a–j*, in turn, is connected to a fluid cylinder 42*a–j*, respectively, which are preferably pneumatic or hydraulic in operation. As described in more detail below in connection with a discussion of FIGS. 5 and 6, the fluid cylinders 42*a–j* are effective to move the transfer units 12*a–j* between a filling position or station 44 spaced from the manifold 16, and a discharge position or station 46 located at the manifold 16.

In addition to the coating material transfer units 12*a–j*, the apparatus 10 of this invention includes a water shuttle 48 and a water transfer unit 50 which are connected by lines 52, 54, respectively, to a water supply 56. The water shuttle 48 is movable between a neutral position spaced from the manifold 16, and a transfer position located at the manifold 16, by operation of a fluid cylinder 58. Similarly, the water transfer unit 50 is movable between a neutral position and a transfer position with respect to the manifold 16 by operation of a second fluid cylinder 60 connected thereto. As described in more detail below, both the water shuttle 48 and water transfer unit 50 are releasably coupled to the water valve 24 to supply flushing liquid into and through the interior 18 of manifold 16, or through the water flush tube 32, to the coating dispenser(s) 30.

The entire operation of apparatus 10 is governed by a commercially available controller 62 of the type having internal pneumatic valves and programmable controls. The controller 62 is connected by a line 64 to a pressurized air supply 66, and by a series of other lines to each of the elements of apparatus 10. Specifically, the controller 62 is connected by lines 68*a–j* to respective fluid cylinders 42*a–j*, and by lines 70 and 72 to the fluid cylinders 58, 60, respectively. The operation of water valve 24 and air purge valve 26 is governed by the controller 62 via signals through lines 74 and 76, respectively, and the operation of coating dispenser 30 is controlled by the controller 62 via line 78. The detailed operation of controller 62 is discussed below in connection with a description of the operation of apparatus 10. Overall Construction of Apparatus 300

Figure 9:
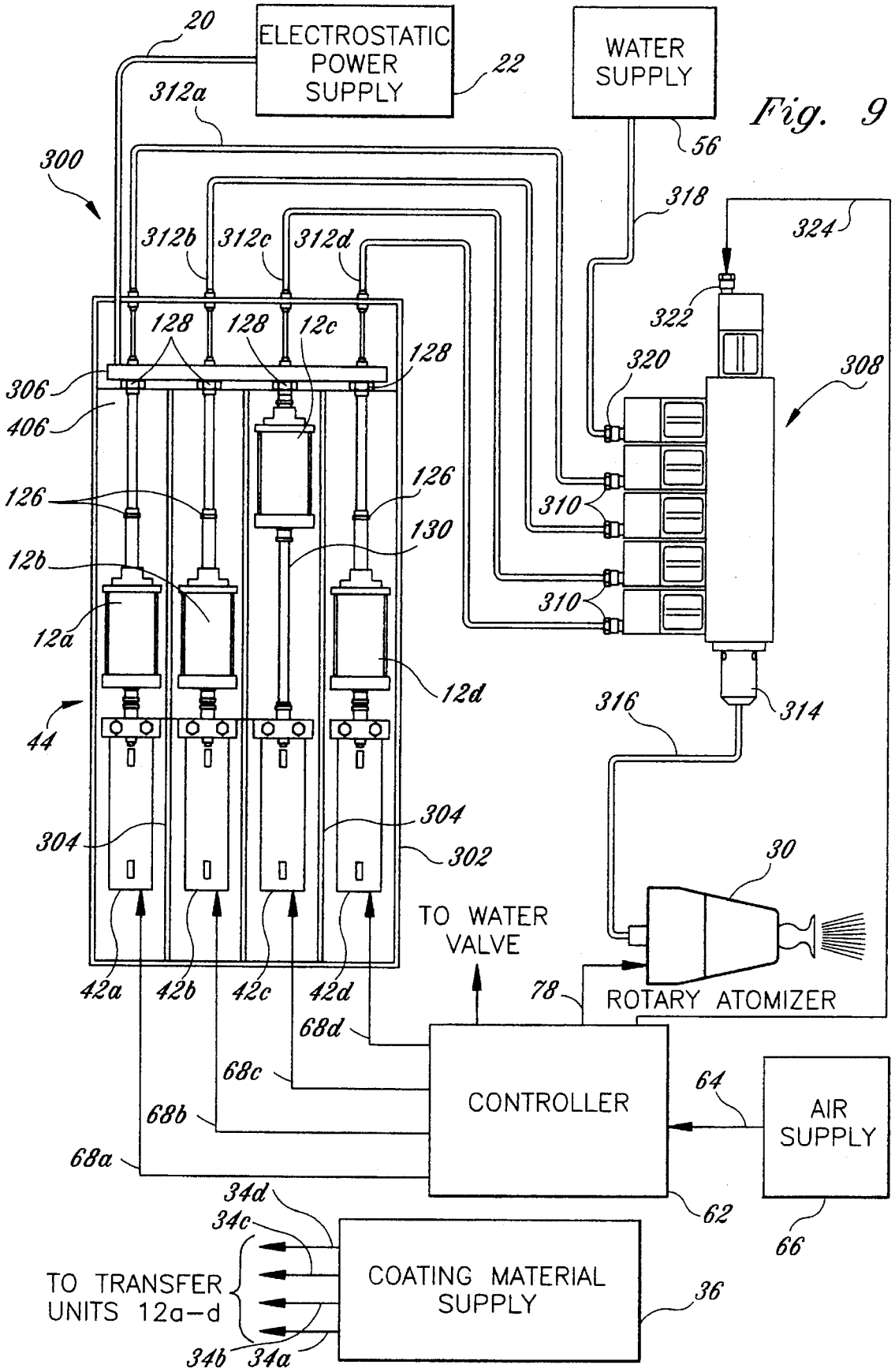
FIG. 9 is a view of an alternative embodiment of the coating transfer system of this invention.

With reference now to FIG. 9, an alternative embodiment of an apparatus 300 according to this invention is schematically depicted. The apparatus 300 is similar in many respects to apparatus 10 described above and depicted in FIGS. 1–4. For purposes of the present discussion, structure shown in apparatus 300 which is common to that of apparatus 10 is given the same reference numbers in FIG. 9 as in FIGS. 1–4.

In the embodiment shown in FIG. 9, the apparatus 300 includes four coating material transfer units 12*a–d* of the same type described above, which are mounted within a cabinet 302 by mounting rods 304. Each transfer unit 12*a–d* is connected by a line 34*a–d*, respectively, to the same type of coating material supply 36 shown in FIG. 1. As described above, movement of the transfer units 12*a–d* is controlled by operation of fluid cylinders 42*a–d*, respectively, which are controlled by controller 62 via lines 68*a–d*.

The transfer units 12*a–d* are movable between a filling station 44 located at their respective fluid cylinders 42*a–d*, and a discharge position or station 46 located at a support bar 306 carried at the top of cabinet 302. This support bar 306 is connected by high voltage line 20 to electrostatic power supply 22 as in FIG. 1.

The primary difference between apparatus 300 and apparatus 10 is the manner in which different colored coating materials are transmitted from the various transfer units 12*a–d* to one or more coating dispensers 30. Instead of a manifold 16, the apparatus 300 of this embodiment employs a color changer 308 which is interposed between the transfer units 12*a–d* and at least one coating dispenser 30 such as described above. In the presently preferred embodiment, the color changer 308 is of the type described in U.S. Pat. No. 4,657,047 to Kolibas, owned by the assignee of this invention, the disclosure of which is incorporated by reference in its entirety herein. Color changer 308 includes a number of inlets 310 each connected by a line 312*a–d*, respectively, to one of the transfer units 12*a–d*. As disclosed in U.S. Pat. No. 4,657,047, the color changer 308 has an outlet 314 connected by a line 316 to dispenser 30. Additionally, a water line 318 is connected to a water inlet 320 of color changer 308 from a water supply 56 as in FIG. 1, and an air inlet 322 is also provided which is connected by a line 324 to a source of pressurized air 66 via controller 62. As described in more detail below, the transfer units 12*a–d* are selectively movable to a discharge position 46 at the support bar 306 where they are interconnected to a respective coating line 312*a–d* for the transmission of coating material to the color changer 308. The color changer 308, in turn, supplies the coating material to dispenser 30 for application onto a substrate.

Coating Material Transfer Units

Figure 5:
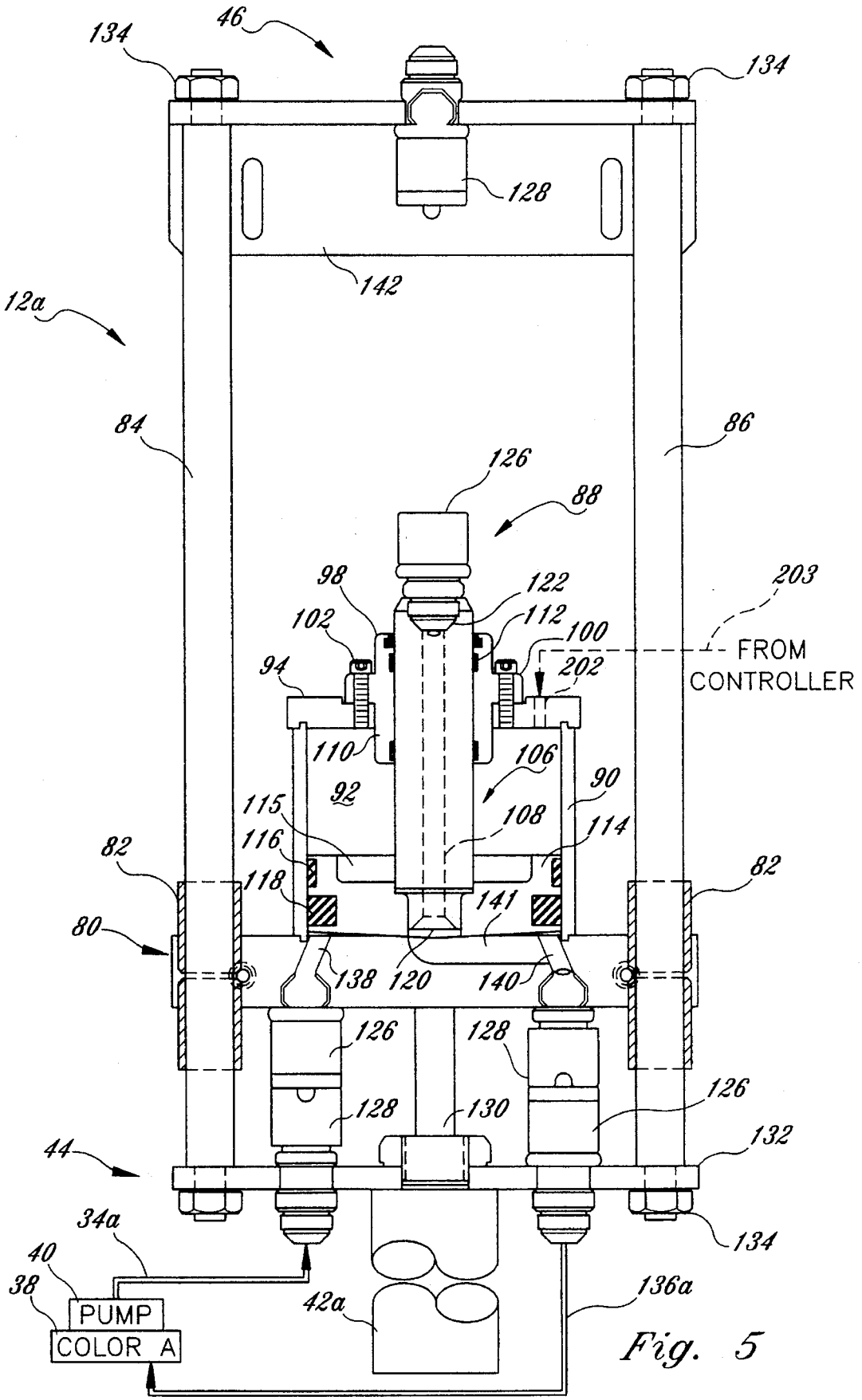
FIG. 5 is an enlarged elevational view, in partial cross section, depicting one embodiment of a coating transfer unit of this invention located at the filling station.
Figure 6:
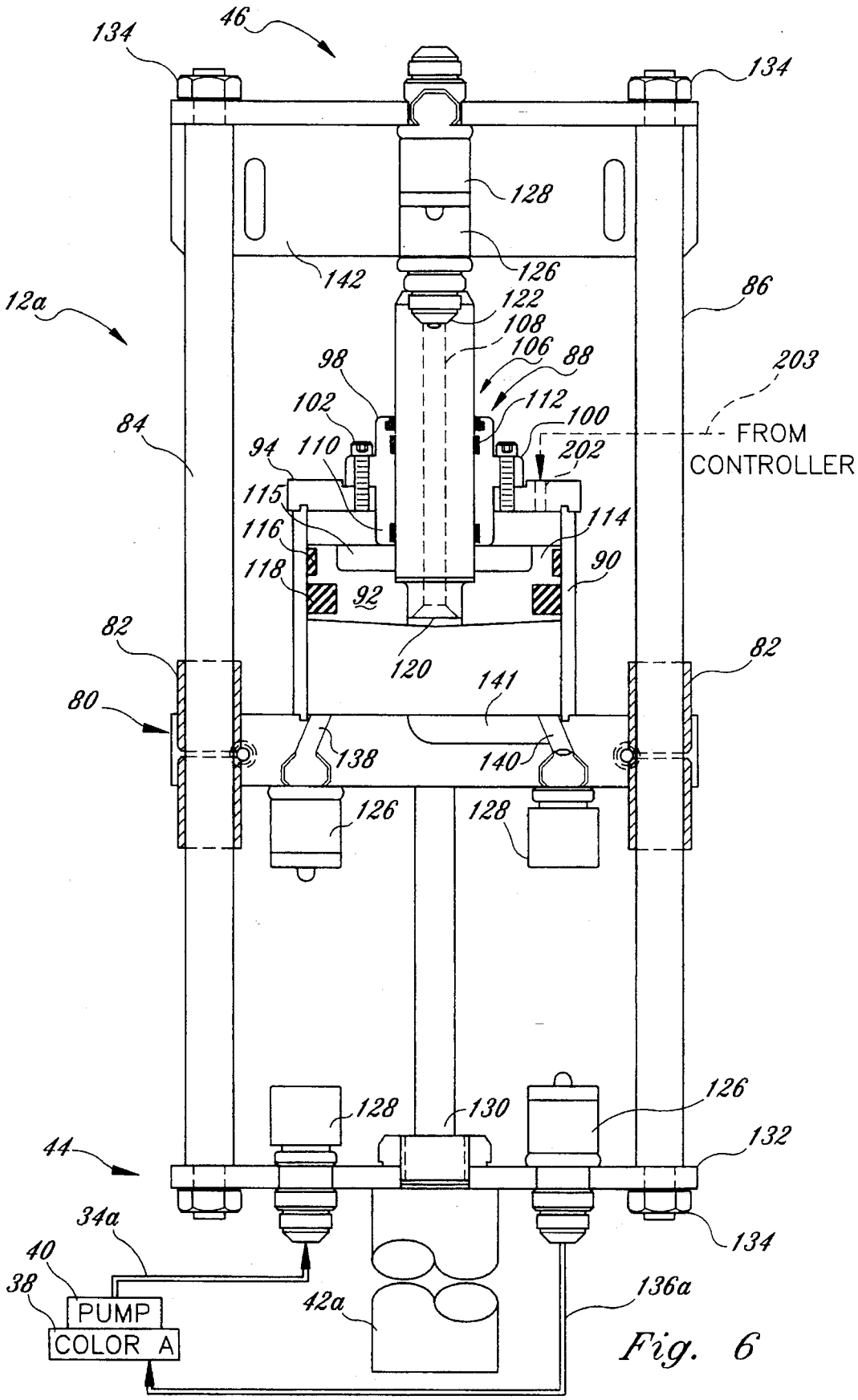
FIG. 6 is a view similar to FIG. 5 except with the coating transfer unit at the discharge station.

With reference initially to FIGS. 5 and 6, the coating material transfer units 12*a–j* are illustrated in detail. It should be understood that each of the transfer units 12*a–j* is identical in structure and operation, and therefore only the transfer unit 12*a* is described herein.

The transfer unit 12*a* comprises a shuttle 80 having opposed ends which are mounted by bushings 82 onto a pair of guide rods 84, 86 extending between the filling station 44 and discharge station 46. The shuttle 80 carries a pumping device 88 which includes a pump body having a generally cylindrical-shaped wall 90 defining a hollow interior 92 closed at one end by a cap 94. The opposite end of wall 90 is mounted atop the shuttle 80. The cap 94 is formed with a central throughbore which mounts a sleeve 98 having flanges 100 which receive mounting screws 102 insertable into the cap 94. The sleeve 98, in turn, is formed with a throughbore which slidably receives a pump piston 106 having a central passageway 108. Preferably, a pair of o-ring seals 110, 112 are carried by the sleeve 98 along the throughbore therein to create a seal with the pump piston 106.

One end of the pump piston 106 mounts a piston head 114 having an outer circumference which carries an o-ring seal 116. A second, annular seal 118 is carried in a seat formed at the base of piston head 114 which, in addition to seal 116, provides a fluid tight connection between the piston head 114 and the wall 90 of pumping device 88 as the piston head 114 moves within the pump interior 92 in the manner described below. The central passageway 108 of pump piston 106 has an inlet 120 at the piston head 114, and an outlet 122 which mounts a female coupling element 126. The female coupling element 126 mates with a male coupling element 128 located at the discharge station 46, as described in more detail below. Coupling elements 126, 128 are preferably of the type disclosed in U.S. Pat. No. 5,078,168, owned by the assignee of this invention, the disclosure of which is incorporated by reference in its entirety herein.

As noted above, each of the transfer units 12*a–j* is associated with a separate fluid cylinder 42*a–j*. As shown in FIG. 5, the fluid cylinder 42*a* is connected by piston rod 130 to the shuttle 80 such that extension and retraction of the piston rod 130 moves the shuttle 80, and, hence, the pumping device 88, between the filling station 44 (FIG. 5) and the discharge station 46 (FIG. 6). The fluid cylinder 42*a* is carried by a plate 132 to which the guide rods 84, 86 are mounted by bolts 134. The plate 132 also carries a male coupling element 128 connected by line 34*a* to pump 40 associated with container 38 having a particular colored coating material therein, e.g. "Color A" as noted in FIGS. 5 and 6. A female coupling element 126 is also mounted to plate 132, which is connected by a return line 136*a* to the container 38.

With the shuttle 80 and pumping device 88 of transfer unit 12 located at the filling station 44, the male coupling element 128 carried by plate 132 mates with a female coupling element 126 mounted at the base of shuttle 80, and the female coupling element 126 carried by plate 132 mates with a male coupling element 128 mounted to the base of shuttle 80. As shown in FIG. 5, the female coupling element 126 carried by the shuttle 80 is located at the entrance of an inlet passageway 138 formed in the shuttle 80 which has an outlet within the interior 92 of pumping device 88. Similarly, the male coupling element 128 mounted at the base of shuttle 80 is connected to the outlet of an outlet or return passageway 140 formed in shuttle 80 whose opposite end opens into the interior 92 of pumping device 88. Preferably, a drain channel 141 is formed along the upper portion of shuttle 80, within the pump interior 92, which is connected to the return passageway 140.

As described more fully below, coating material from the container 38 is directed by pump 40 via line 34*a* through the coupling elements 126, 128, into the inlet passage 138 of shuttle 80, and from there to the interior 92 of pumping device 88. This causes the pump piston 106 and piston head 114 to move upwardly as a unit relative to the pump interior 92, i.e. in a vertically upward direction as drawn in FIG. 5. Movement of the piston head 114 ceases when it engages the cap 94 of pumping device 88, and a recess 115 is formed along the upper surface of piston head 114 to avoid interference with sleeve 98. Continued operation of pump 40 after the interior 92 of pumping device 88 has been filled causes the coating material to recirculate from the pump interior 92, through return passageway 140 and return line 136*a*, back to the container 38.

Once filled with coating material, the shuttle 80 and pumping device 88 can be moved, if desired, into position at the discharge station 46 located at manifold 16. This is achieved by operating fluid cylinder 42 to extend its piston rod 130, thus separating the coupling elements 126, 128 at the filling station 44 and causing the female coupling element 126 carried by the pump piston 106 to engage and mate with the male coupling element 128 at the discharge station 46. In the presently preferred embodiment, a bracket 142 is located at the discharge station 46 which mounts the opposite end of guide rods 84, 86 with bolts 134. The bracket 142 also mounts the male coupling element 128, which, in turn, is connected to the interior 18 of manifold 16.

Figure 7:
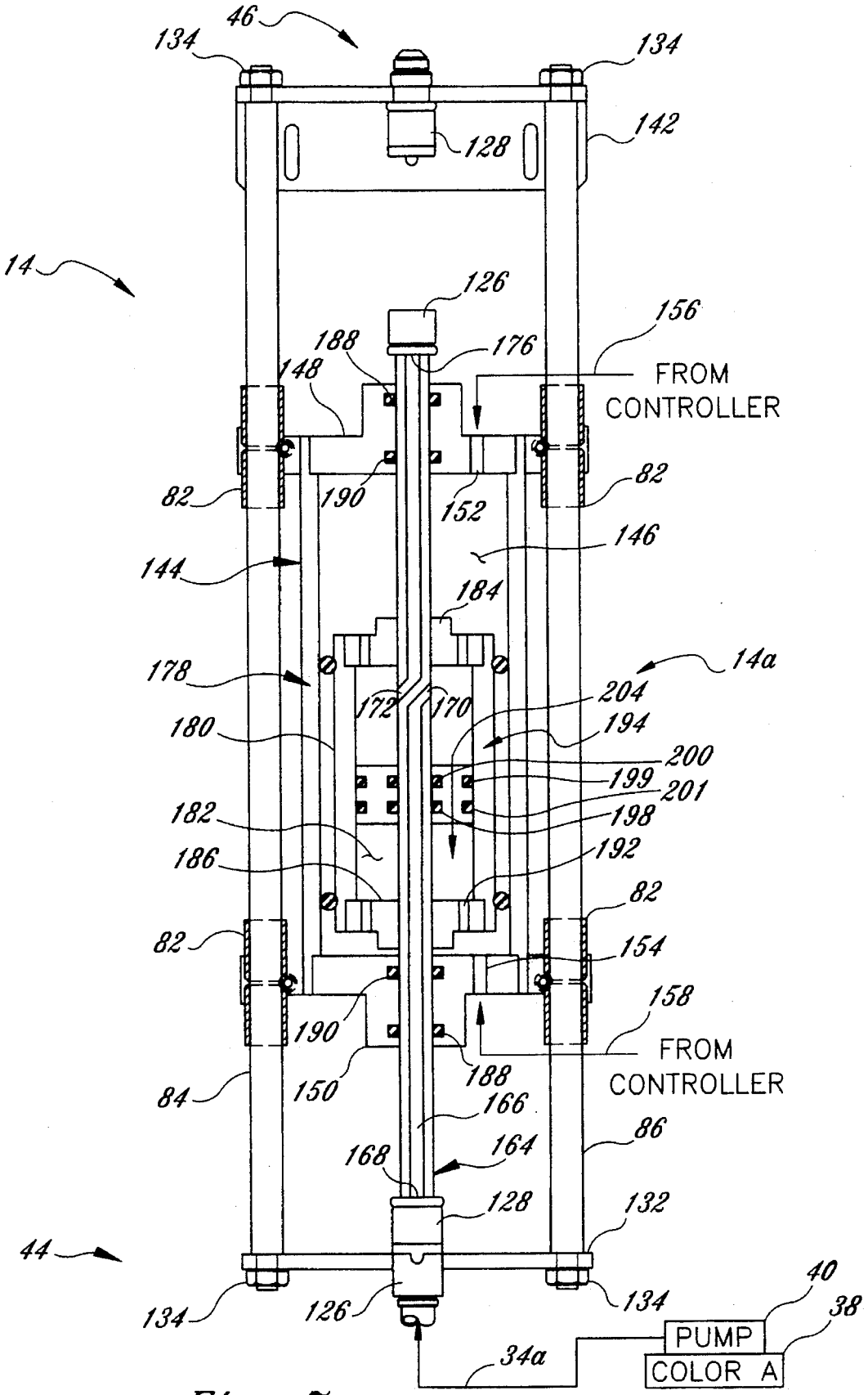
FIG. 7 is an elevational view, in partial cross section, of an alternative embodiment of a coating transfer unit of this invention located at the filling station.
Figure 8:
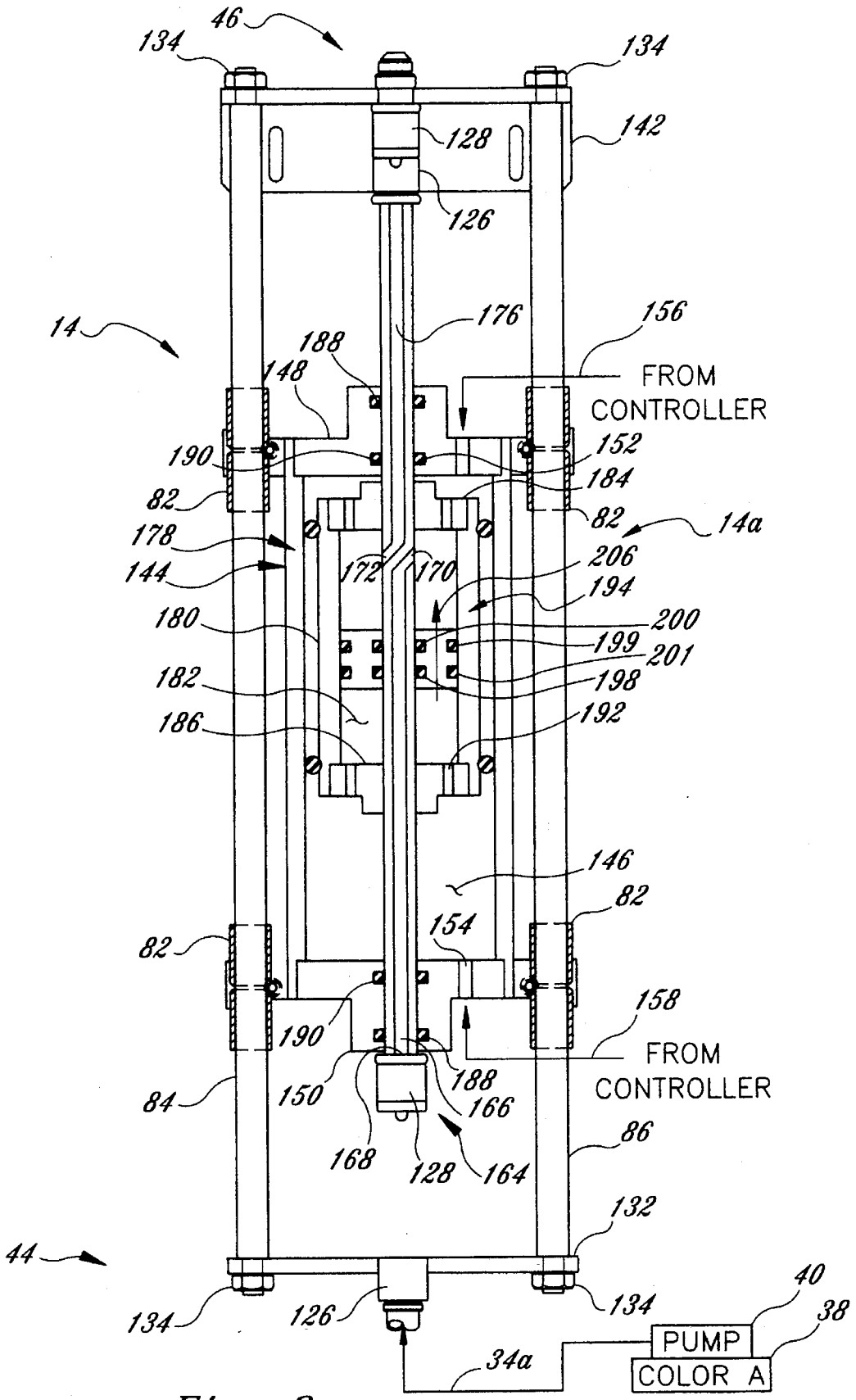
FIG. 8 is a view similar to FIG. 7 except with the coating transfer unit at a discharge station.

With reference now to FIGS. 7 and 8, the alternative transfer unit 14 is illustrated in detail. Transfer units 14*a–j* are employed in the apparatus 10 in the same manner as described above, except for a slight modification at the filling station 44, and the elimination of fluid cylinders 42*a–j*.

In the presently preferred embodiment, transfer unit 14*a* comprises a shuttle 144 having a hollow interior 146 which is closed at opposite ends by a first end cap 148 and a second end cap 150. The shuttle 144 is movable along guide rods 84, 86 as with the shuttle 80 described above. The end caps 148, 150 are formed with air ports 152 and 154, respectively, connected to air lines 156 and 158 from controller 62. Additionally, the end caps 148, 150 each have a central throughbore within which a shaft 164 is fixedly mounted. The shaft 164 is formed with a first passageway 166, having an inlet 168 at one end of shaft 164 and an outlet 170 approximately midway therealong. The shaft 164 is also formed with a second passageway 172 having an inlet 174 adjacent the outlet 170 of first passageway 166, and an outlet 176 at the opposite end of shaft 164. A male coupling element 128 is mounted to shaft 164 at the inlet 168 to first passageway 166, and a female coupling element 126 is mounted at the outlet 176 of the second passageway 172 of shaft 164.

The shuttle 144 carries a pumping device 178 within the hollow interior 146 thereof which is slidable along the fixed shaft 164. The pumping device 178 comprises a pump body 180 having a cylindrical wall defining a hollow interior 182 which is closed at opposite ends by closure plates 184, 186 each having a central bore to slidably receive the shaft 164. Preferably, o-ring seals 188, 190 are carried by each of the closure plates 184, 186 within their throughbores to create a fluid tight seal with shaft 164. Additionally, the closure plate 186 is formed with an air port 192 which extends into the pump interior 182.

A pump piston 194 is slidably mounted on the shaft 164 within the interior 182 of pumping device 178. The circumference of pump piston 94 carries seals 198, 199 to create a fluid tight seal with a cylindrical wall 180 of pumping device 178, and seals 200, 201 are mounted at the interface between the throughbore of pump piston 194 and shaft 164 to create a seal therebetween. The operation of transfer unit 14 is described in detail below in connection with a discussion of the overall operation of apparatus 10.

Coating Operation

With reference initially to FIGS. 1, 5 and 6, the following operations are described: (1) filling each of the transfer units 12*a–j* with coating material, and (2) selectively moving one of the transfer units 12*a–j* to the discharge station 46 to transfer coating material into the manifold 16 for supply to the coating dispensers 30.

The controller 62 is operative to supply pressurized air through lines 34*a–j* to each of the fluid cylinders 42*a–j* so that their piston rods 130 are retracted to move the transfer units 12*a–j* to the filling station 44. As mentioned above, at the filling station 44, the coupling elements 126, 128 carried by shuttle 80 mate with coupling elements 126, 128 mounted to the plate 132. See FIG. 5. Once the shuttle 80 and pumping device 88 of the transfer units 12*a–j* are in position at the filling station 44, each of the pumps 40 within the coating material supply 36 is activated to direct coating material from the individual coating material containers 38 into their associated transfer units 12*a–j*. The coating material flows from containers 38 into supply lines 34*a–j*, each of which leads to a male coupling element 128 carried by the plate 132 at the filling station 44. The coating material passes through the male coupling elements into the mating female coupling elements 126 mounted to shuttle 80, through the inlet passage 138 of shuttle 80 and then into the interior 92 of each pumping device 88. As each pumping device 88 fills with coating material, its piston head 114 moves vertically upwardly as depicted in FIG. 5 carrying with it the pump piston 106. Filling of each pumping device 88 continues until the piston head 114 engages the cap 94. When the pumping device 88 is completely filled, and with the shuttle 80 and pumping device 88 located at the filling station 44, additional coating material entering the pump interior 92 is recirculated back to the container 38 via a flow path formed by the drain channel 141 and return passage 140 in shuttle 80, the mating coupling elements 126, 128 which connect to return passage 140, and, the return line 136 extending between the male coupling element 128 at the discharge station 46 and the container 38. This recirculation feature of transfer unit 12 is advantageous when spraying electrically conductive coating material such as water-based paint because continuous movement of the coating material substantially prevents settlement of sediments and other solid materials contained within the coating material.

In order to initiate a coating operation with a chosen color of coating material, the controller 62 pressurizes the appropriate fluid cylinder 42*a–j* via its associated air line 68*a–j* so that the piston rod 130 of such fluid cylinder 42*a–j* is extended. For purposes of illustration, FIG. 1 shows actuation of fluid cylinder 42*i* which moves transfer unit 12*i* to the discharge station 46 at manifold 16. See also FIG. 6. In the course of movement to the discharge station 46, the coupling elements 126, 128 carried by the shuttle 80 disconnect the mating coupling elements 126, 128 mounted to the plate 132 at the filling station 44. Upon reaching the discharge station 46, the female coupling element 126 carried at the outwardly extending end of pump piston 106 mates with the male coupling element 128 carried by the bracket 142 at the discharge station 46. Because the bracket 142 and male coupling element 128 are mounted in a fixed position at the discharge station 46, the vertically upwardly directed force exerted by the piston rod 130 of fluid cylinder 42*i* forces the pump piston 106 and piston head 114 in the opposite, downward direction within the interior 92 of pumping device 88. In turn, the coating material within the pumping interior 92 is forced, under pressure, through the central passageway 108 of pump piston 106 into the mating coupling elements 126, 128 at the discharge station 46. The coating material enters the manifold interior 18 via the male coupling element 128, and is transferred along manifold 16 through the paint supply tube 28 to one or more coating dispensers 30.

The magnitude of the pressure at which the coating material is supplied to the coating dispensers 30 is therefore dependent upon the force exerted by the piston 130 of fluid cylinder 42*i* on the shuttle 80. The fluid cylinder 42*i* urges the shuttle 80 and pumping device 88 in an upward direction thus forcing the pump piston 106, which has engaged the fixed male coupling element 128, in the opposite, downward direction. In turn, the piston head 114 bears against the coating material within the pumping device interior 92 causing it to enter into the passageway 108 of pump piston 106. The pressure at which the coating material is supplied to the dispensers 30 can be varied by employing fluid cylinders 42 of different size, as desired. Additionally, it is contemplated that an air port 202, shown in phantom in FIGS. 5 and 6, can be formed in the pump cap 94 above the piston head 114 so that pressurized air can be introduced atop the piston head 114 via line 203 from controller 62 to augment the force exerted by the pump piston 106 and piston head 114 on the coating material within the pump interior 92.

Once the piston head 114 has bottomed out within the pump interior 92, or when the coating operation is otherwise discontinued, the controller 62 operates the fluid cylinder 42*i* to retract its piston rod 130 causing the pumping device 88 to disconnect from discharge station 46. The shuttle 80 and pumping device 88 then move as a unit to the filling station 44 where the filling operation takes place again as described above.

With reference to FIGS. 1, 7 and 8, a filling and discharge operation are described for a transfer unit 14*a*, it being understood that all transfer units 14*a–j* are structurally and functionally identical. Initially, the controller 62 is operated to direct pressurized air through line 156 into the air port 152 of shuttle 144. This forces the pumping device 178 in a downward direction as viewed in FIGS. 7 and 8 into engagement with the second end cap 150 of shuttle 144. In turn, both the shuttle 144 and pumping device 178 move downwardly along guide rods 84, 86 to the filling station 44. At the filling station 44, the male coupling element 128 carried at one end of the shaft 164 mates with a female coupling element 126 mounted to the plate 132 depicted schematically in FIG. 7. The female coupling element is connected by line 34*a* to a pump 40 and container 38 located internally of the coating material supply 36. The pump 40 is activated to direct the coating material through line 34*a* to the mating coupling elements 126, 128, and then into the inlet 168 of the first passageway 166 within shaft 164. The coating material is discharged through the outlet 170 of first passageway 166, and into the interior 182 of pumping device 178 on the side of pump piston 194 opposite the air port 192 and closure plate 186. As the pump interior 182 fills with coating material, the pump piston 194 moves in the direction of arrow 204 within the pump interior 182, i.e. along shaft 164 toward the closure plate 186. Filling of the pumping device 178 ceases when pump piston 194 engages closure plate 186.

In order to initiate a coating operation with transfer unit 14*a*, the controller 62 directs pressurized air into line 158 and through the air port 154 in the second end cap 150 of shuttle 144. At the same time, pressurized air within the shuttle interior 146 is vented through air port 152 and line 156. Pressurization of the shuttle 144 through line 158 and air port 154 causes the entire pumping device 178 to move toward and engage the first end cap 148. In turn, both the shuttle 144 and pumping device 178 move along guide rods 84, 86 to the discharge station 46 at the manifold 16 where the female coupling element 126 carried by shaft 164 mates with the male coupling element 128 mounted to bracket 142.

Because the air port 192 within closure plate 186 of pumping device 178 is located on the same end of shuttle 144 as air port 154, the interior of pumping device 178 becomes pressurized with the air from line 158. Consequently, the pump piston 194 of pumping device 178 is forced in a direction toward the closure plate 184 of pumping device 178, as shown by arrow 206 in FIG. 8. Coating material within the pump interior 182 is forced into the second passageway 172 within shaft 164 from which it flows through the interconnected coupling elements 126, 128 at the discharge station 46 into the manifold 16. The coating material continues through manifold 16 into paint supply tube 28 to the coating dispensers 30. The magnitude of the pressure at which the coating material is supplied to the dispensers 30 is therefore dependent upon the air pressure applied to the pump piston 194 via line 158 and controller 62.

When the coating operation has been completed, or is otherwise discontinued, the shuttle 144 and pumping device 178 are returned to the filling station 44 by directing pressurized air from controller 62 into line 156 and venting air from the opposite end of shuttle 144 through line 158. The pump filling procedure is then repeated as discussed above in preparation for another coating operation.

The operation of apparatus 300 is similar to that described above in connection with a discussion of apparatus 10, except the manifold 16 is eliminated and a color changer 308 is employed. Each of the transfer units 12*a–d* is selectively movable to the discharge station 46 at the support bar 306 in the manner described above, so that the coupling element 126 of each shuttle 80 mates with a coupling element 128 carried by the support bar 306. The pumping device 88 then operates to discharge coating material, as described above, to provide a flow of coating material through one of the lines 312*a–d* to the color changer 308. The color changer 308, in turn, directs coating material of a selected color through line 312 to dispenser 30.

Cleaning Operation

With reference now to FIGS. 1–4, the manifold 16, paint supply tube 28 and dispensers 30 can be easily and quickly cleaned of coating material of one color in preparation for a spraying with coating material of another color. Regardless of whether transfer unit 12 or transfer unit 14 is utilized, the cleaning operation proceeds as follows.

Initially, the controller 62 directs pressurized air to the fluid cylinder 60 associated with water transfer unit 50. The fluid cylinder 60 moves water transfer unit 50 into position at the water valve 24. See FIG. 2. Preferably, the water valve 24 and water transfer unit 50 have mating coupling elements 126, 128 of the type described above. Additionally, in the presently preferred embodiment, the structure and operation of water transfer unit 50 is identical to the transfer units 12 previously discussed.

The arrival of the water transfer unit 50 at water valve 24 is timed to take place near the end of a painting cycle, e.g. such as when the interior **92*i* of transfer unit 12*i* is nearly emptied of paint or the painting operation is otherwise ready to be terminated. The controller 62 then depressurizes the fluid cylinder 42*i* associated with transfer unit 12*i* to stop the flow of paint therefrom, and opens water valve 24 to permit a flow of water or other cleaning fluid from the pumping device 88 of water transfer unit 50 into the interior of manifold 16. The flow of water within manifold 16 "pushes" the paint remaining therein, and within the supply tube 28, through the dispenser 30 and onto the object to be coated. Consequently, the system 10 is still painting, even with the transfer unit 12*i* disengaged, in response to the "push" provided by the water from water transfer unit 50. Because the water transfer unit 50 is electrically isolated in the same manner as transfer units 12, the system electrostatics are not grounded while the paint remaining within manifold 18 and supply tube 28 is transferred to dispenser 30. The flow of water from water transfer unit 50 is timed by the controller 62 to stop before the water is discharged from dispenser 30. At that time, both the transfer unit 12*i* which was supplying coating material, and the water transfer unit 50, are returned to their respective filling stations 44 and the electrostatic power supply 22 is turned off. The controller 62 then operates the fluid cylinder 58 to move water shuttle 48 into a coupled position at the water valve 24. The controller 62 opens the water valve 24, and opens the air purge valve 26, to direct a combination of air and water through the interior 18 of manifold 16, into paint supply tube 28 and into coating dispenser 30. The combined air/water mixture is effective to remove coating material from the interior 18 of manifold 16 and from the paint supply tube 28 leading to dispenser 30. After the manifold 16 and paint supply tube 28 have been thoroughly flushed and cleaned, the controller 62 operates fluid cylinder 58 to return the water shuttle 48 to a neutral position spaced from the manifold 16**.

Figure 4:
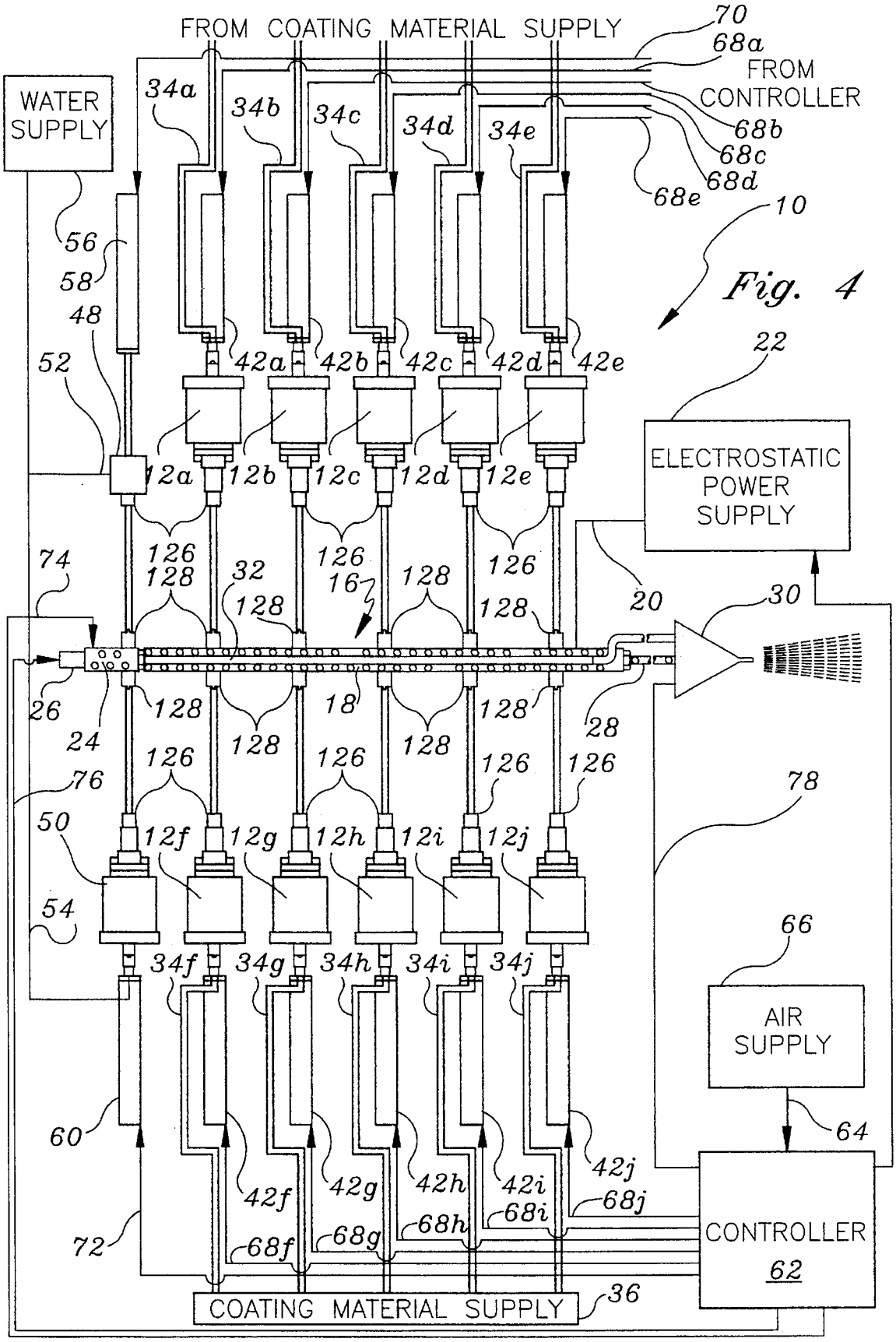
FIG. 4 is a view similar to FIG. 1 wherein pressurized air is directed through,the system.

In the presently preferred embodiment, as shown in FIG. 4, the air purge valve 26 is then reopened by the controller 62 to direct pressurized air through the manifold 16, paint supply tube 28 and coating dispensers 30 to purge the cleaning water from the system. After the air purge is completed, the controller 62 closes the air purge valve 26 and operates one of the fluid cylinders **42*a–j* to move a selected transfer unit 12*a–j* to its discharge station 46 at manifold 16. The coating operation with a different colored coating material from such other transfer unit 12*a–j*** is then initiated in the same manner as described above.

It is contemplated that in addition to the above-described cleaning operation, the nozzle or cup (not shown) of the coating dispenser 30 should be cleaned in those situations where it is desired to continue painting with the same color of coating material after an initial coating operation is completed, or in the event a coating operation is interrupted. Without a separate cleaning operation for dispenser 30, it is contemplated that coating material could at least partially dry or clump up within the dispenser interior and/or the nozzle or cup thereof before the painting operation was resumed, thus producing an unacceptable spray pattern when the coating operation is resumed.

A cleaning operation for the dispenser 30, and particularly the nozzle or cup portion thereof, proceeds as follows. Initially, the flow of paint from one of transfer units **12*a–j* is terminated, and the electrostatic power supply 22 is turned off to deenergize the manifold 18 and dispenser 30. The shuttle 80 associated with the transfer unit 12*a–j* which was painting, e.g. shuttle 80 of transfer unit 12*i*, is returned to its filling station 44 to receive additional coating material. The controller 62 then moves either the water shuttle 48 or water transfer unit 50 into coupling engagement with water valve 24, and opens the water valve 24 so that it communicates with water flush tube 32. Preferably, the water valve 24 is a two position valve which is adjustable to permit the flow of water or other flushing liquid either into the interior 18 of manifold 16 or into the water flush tube 32 within the manifold interior 18. With the water flush valve 24 in proper position, a flow of water from either water shuttle 48 or water transfer unit 50 flows therethrough, into the water flush tube 32 and then into the dispenser 30. The dispenser 30 is triggered, either manually or automatically by controller 62, to flush any residue paint therefrom and particularly from the area of the nozzle or cup portion of the dispenser 30. The water shuttle 48 or water transfer unit 50 is then disengaged from the water valve 24 and returned to the initial position, while the dispenser 30 is triggered again to remove any remaining water therein. The apparatus 10 is now ready for the painting operation to resume, either by returning the now re-filled transfer unit 12*i* to the manifold 16 or moving another transfer unit 12 carrying the same color to the manifold 16**.

The cleaning operation for apparatus 300 proceeds differently since only the color changer 308, outlet line 316 and dispenser 30 must be flushed to convert from one color of coating material to another. The controller 62 operates a valve (not shown) associated with the inlet 320 of color changer 308 to permit the flow of water into the color changer 308 via water line 318, and then through outlet line 316 to dispenser 30. Simultaneous with and/or subsequent to the water flush sequence, the controller 62 operates a valve associated with the color changer 308, which is connected via air line 324 and controller 62 to air supply 66, to allow the introduction of pressurized air into color changer 308. The combined water and air flush of color changer 308, coating line 316 and dispenser 30 after one coating operation with one color is effective to rapidly prepare the apparatus 300 for another coating operation with a different color.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, the invention has been described and shown as either including a manifold 16 or a color changer 308 so that a number of different sources of coating material can be employed, each associated with a separate coating transfer unit 12 or 14. It is also contemplated that the apparatus 10 of this invention could be fabricated with a single source, one set of filling and discharge stations and a single coating transfer unit 12 or 14, wherein the manifold and color changer are eliminated. In this embodiment, the source is connected to the filling station, the discharge station is connected to at least one coating dispenser and the coating transfer unit is movable between the filling station and discharge station.

Therefore, it is intended that the invention not be limited to the particular embodiment disclosed as the best mode contemplated for carrying out this invention, but that the invention will include all embodiments falling within the scope of the appended claims.

We claim:

1. Apparatus for supplying electrically conductive coating material, comprising:

a manifold connectable to at least one coating dispenser, said manifold including a number of discharge stations;

a number of filling stations each connected to a different source of coating material, said filling stations being electrically isolated from said discharge stations;

a number of coating transfer units each including a combined shuttle and pumping device, each of said combined shuttle and pumping devices being movable to one of said filling stations to receive a quantity of coating material from a different source of coating material and then selectively movable to one of said discharge stations to transfer the coating material into said manifold.

2. The apparatus of claim 1 in which:

each of said coating transfer units includes at least one first coupling element which mates with at least one second coupling element located at a respective filling station, said at least one second coupling element of each filling station being connected to a different source of coating material to permit the transfer of coating material into said pumping device of each coating transfer unit; and each of said coating transfer units includes at least one third coupling element which mates with at least one fourth coupling element located at a respective discharge station, said at least one fourth coupling element being connected to said manifold to permit the transfer of coating material from said pumping device of each coating transfer unit into said manifold.

3. The apparatus of claim 2 in which each of said transfer units includes:

a fluid cylinder having a piston rod connected to said combined shuttle and pumping device, said piston rod being extendable and retractable to move said combined shuttle and pumping device between said discharge station and said filling station;

guide rods extending between said discharge station and said filling station, said shuttle being movably mounted to said guide rods.

4. The apparatus of claim 3 in which each of said combined shuttle and pumping devices has a shuttle formed with an inlet passageway and an outlet passageway, said inlet and outlet passageways each having one end mounted to one of said first and second coupling elements.

5. The apparatus of claim 4 in which said pumping device of each of said combined shuttle and pumping devices comprises;

a pump body having a hollow interior, said pump body being mounted to said shuttle so that one end of each of said inlet passageway and said outlet passageway communicates with said hollow interior;

a piston head movable within said pump body;

a pump piston having a first end connected to said piston head and a second end extending outwardly from said pump body, said pump piston being formed with an internal passageway which communicates with said interior of said pump body;

said third coupling device being mounted to said second end of said pump piston.

6. The apparatus of claim 5 in which said pump body includes a cylindrical wall having a first end connected to said shuttle and a second end which mounts a cap, said cap mounting a sleeve formed with a throughbore within which said pump piston is axially slidable.

7. The apparatus of claim 2 in which said manifold comprises:

a tubular wall having a hollow interior connectable to a coating dispenser;

a water flush tube mounted within said hollow interior, said water flush tube being connectable to the coating dispenser;

a valve connected to one end of said hollow interior, said valve being connectable to a source of cleaning fluid.

8. The manifold of claim 7 in which said valve is a water valve connectable to a source of water.

9. The manifold of claim 7 in which said valve is an air valve connectable to a source of pressurized air.

10. The apparatus of claim 1 in which each of said combined shuttle and pumping devices has a shuttle formed with a hollow interior having opposed ends, each of said opposed ends mounting an end cap formed with a central throughbore and an air port.

11. The apparatus of claim 10 in which said pumping device associated with each of said combined shuttle and pumping devices comprises:

a pump body having a hollow interior and opposed ends, each of said opposed ends mounting a closure plate formed with a central throughbore, one of said closure plates being formed with an air port;

a pump shaft formed with a first passageway and a second passageway, said pump shaft extending through said throughbores in said end caps of said shuttle and being fixed thereto, said pump shaft slidably extending through said throughbores in each of said closure plates of said pump body, said pump shaft having opposed ends one of which mounts said first coupling device and the other of which mounts said third coupling device;

a piston head slidably mounted on said pump shaft within said hollow interior of said pump body.

12. The apparatus of claim 11 in which said first passageway formed in said pump shaft has an inlet connected to said first coupling device to permit the transfer of coating material from said second coupling device at said filling station into said interior of said pump body, said first passageway of said pump shaft having an outlet located within said interior of said pump body in position such that said piston head is disposed between said outlet and said air port in said one closure plate.

13. The apparatus of claim 11 in which said second passageway formed in said pump shaft has an inlet located within said interior of said pump body in position such that said piston head is disposed between said inlet and said air port in said one closure plate, said second passageway having an outlet connected to said third coupling device to permit the transfer of coating material from said interior of said pump body into said manifold at said discharge station.

14. Apparatus for supplying electrically conductive coating material, comprising:

a manifold connectable to at least one coating dispenser;

a number of filling stations each connectable to a different source of coating material, and a number of discharge stations connected to said manifold, said filling stations being electrically isolated from said discharge stations;

a number of coating transfer units each movable between a respective filling station and discharge station, each of said coating transfer units including:

(i) a shuttle formed with an inlet passageway and an outlet passageway;

(ii) a pumping device mounted to said shuttle, said pumping device having a hollow interior communicating with said inlet and outlet passageways, a piston head movable within said hollow interior, and a pump rod having a first end connected to said piston head;

(iii) a first coupling element mounted to said shuttle at said inlet passageway, a second coupling element mounted to said shuttle at said outlet passageway and a third coupling element mounted to the second end of said pump rod;

said filling station including coupling elements matable with said first and second coupling elements carried by said shuttle, said discharge station including a coupling element matable with said third coupling element mounted to said pump rod.

15. The apparatus of claim 14 in which said pump rod has an internal passageway formed with an inlet within said hollow interior of said pumping device, and an outlet connected to said third coupling element.

16. The apparatus of claim 14 in which each of said transfer units includes:

a fluid cylinder having a piston rod connected to said shuttle, said piston rod being extendable and retractable to move said shuttle and said pumping device between said discharge station and said filling station;

guide rods extending between said discharge station and said filling station, said shuttle being movably mounted to said guide rods.

17. The apparatus of claim 14 in which said pumping device includes a cylindrical wall having a first end connected to said shuttle and a second end which mounts a cap, said cap mounting a sleeve formed with a throughbore within which said pump piston is axially slidable.

18. The apparatus of claim 14 in which said manifold comprises:

a tubular wall having a hollow interior connectable to a coating dispenser;

a water flush tube mounted within said hollow interior, said water flush tube being connectable to the coating dispenser;

a valve connected to one end of said hollow interior, said valve being connectable to a source of cleaning fluid.

19. The manifold of claim 18 in which said valve is a water valve connectable to a source of water.

20. The manifold of claim 18 in which said valve is an air valve connectable to a source of pressurized air.

21. Apparatus for supplying electrically conductive coating material, comprising:

a manifold connectable to at least one coating dispenser;

a number of filling stations each connectable to a different source of coating material, and a number of discharge stations connected to said manifold, said filling stations being electrically isolated from said discharge stations;

a number of coating transfer units each movable between a respective filling station and discharge station, each of said coating transfer units including:

(i) a shuttle having a hollow interior closed at opposite ends;

(ii) a pumping device having a hollow interior, closed at opposite ends, which slidably receives a piston head;

(iii) a pump shaft formed with a first passageway and a second passageway, said pump shaft extending through said shuttle and being fixed to said opposed ends thereof, said pump shaft slidably extending through said piston head and said opposed ends of said pumping device;

said pump shaft mounting a first coupling element at one end thereof which connects to said passageway, said first coupling element being matable with a second coupling element located at said filling station which is connected to a source of coating material, said pump shaft mounting a third coupling element at the opposite end thereof which connects to said second passageway, said third coupling element being matable with a fourth coupling element located at said discharge station which is connected to said manifold.

22. The apparatus of claim 21 in which said each of said opposed ends of said shuttle mounts an end cap formed with a central throughbore and an air port.

23. The apparatus of claim 22 in which each of said opposed ends of said pumping device mounts a closure plate each formed with a central throughbore, one of said closure plates being formed with an air port.

24. The apparatus of claim 23 in which said first passageway formed in said pump shaft has an inlet connected to said first coupling device to permit the transfer of coating material from said second coupling element at said filling station into said interior of said pump body, said first passageway of said pump shaft having an outlet located within said interior of said pump body in position such that said piston head is disposed between said outlet and said air port in said one closure plate.

25. The apparatus of claim 23 in which said second passageway formed in said pump shaft has an inlet located within said interior of said pump body in position such that said piston head is disposed between said inlet and said air port in said one closure plate, said second passageway having an outlet connected to said third coupling device to permit the transfer of coating material from said interior of said pump body into said manifold at said discharge station.

26. Apparatus for supplying electrically conductive coating material, comprising:

a manifold connectable to at least one coating dispenser, said manifold including a number of discharge stations;

a number of filling stations each connected to a different source of coating material, said filling stations being electrically isolated from said discharge stations;

a number of coating transfer units each including a combined shuttle and pumping device, said pumping device of each combined shuttle and pumping device having a piston head movable within a hollow pump interior formed with an inlet passageway and an outlet passageway;

a number of fluid cylinders each having a piston connected to said combined shuttle and pumping device of one of said coating transfer units, said fluid cylinders each being operative to extend and retract said piston thereof to move a respective combined shuttle and pumping device between said filling station at which coating material enters said hollow pump interior and said discharge station, said fluid cylinders each exerting a force against said shuttle at said discharge station which causes said piston head to direct coating material out of said hollow pump interior, through said outlet passageway therein and into said manifold.

27. Apparatus for supplying electrically conductive coating material, comprising:

a color changer connectable to at least one coating dispenser, said color changer being connected to a number of discharge stations;

a number of filling stations each connected to a different source of coating material, said filling stations being electrically isolated from said discharge stations;

a number of coating transfer units each including a combined shuttle and pumping device, each of said combined shuttle and pumping devices being movable to one of said filling stations to receive a quantity of coating material from a different source of coating material and then selectively movable to one of said discharge stations to transfer the coating material to said color changer.

28. The apparatus of claim 27 in which said color changer is formed with a number of inlets and at least one outlet connectable to said at least one coating dispenser, each of said inlets being connected by a separate line to one of said discharge stations.

29. The apparatus of claim 27 in which each of said combined shuttle and pumping devices has a shuttle formed with an inlet passageway and an outlet passageway, said inlet and outlet passageways each having one end mounted to one of said first and second coupling elements.

30. The apparatus of claim 29 in which said pumping device of each of said combined shuttle and pumping devices comprises;

a pump body having a hollow interior, said pump body being mounted to said shuttle so that one end of each of said inlet passageway and said outlet passageway communicates with said hollow interior;

a piston head movable within said pump body;

a pump piston having a first end connected to said piston head and a second end extending outwardly from said pump body, said pump piston being formed with an internal passageway which communicates with said interior of said pump body;

said third coupling device being mounted to said second end of said pump piston.

31. The apparatus of claim 30 in which said pump body includes a cylindrical wall having a first end connected to said shuttle and a second end which mounts a cap, said cap mounting a sleeve formed with a throughbore within which said pump piston is axially slidable.

32. The apparatus of claim 27 in which each of said combined shuttle and pumping devices has a shuttle formed with a hollow interior having opposed ends, each of said opposed ends mounting an end cap formed with a central throughbore and an air port.

33. The apparatus of claim 32 in which said pumping device associated with each of said combined shuttle and pumping devices comprises:

a pump body having a hollow interior and opposed ends, each of said opposed ends mounting a closure plate formed with a central throughbore, one of said closure plates being formed with an air port;

a pump shaft formed with a first passageway and a second passageway, said pump shaft extending through said throughbores in said end caps of said shuttle and being fixed thereto, said pump shaft slidably extending through said throughbores in each of said closure plates of said pump body, said pump shaft having opposed ends one of which mounts said first coupling device and the other of which mounts said third coupling device;

a piston head slidably mounted on said pump shaft within said hollow interior of said pump body.

34. The apparatus of claim 33 in which said first passageway formed in said pump shaft has an inlet connected to said first coupling device to permit the transfer of coating material from said second coupling device at said filling station into said interior of said pump body, said first passageway of said pump shaft having an outlet located within said interior of said pump body in position such that said piston head is disposed between said outlet and said air port in said one closure plate.

35. The apparatus of claim 33 in which said second passageway formed in said pump shaft has an inlet located within said interior of said pump body in position such that said piston head is disposed between said inlet and said air port in said one closure plate, said second passageway having an outlet connected to said third coupling device to permit the transfer of coating material from said interior of said pump body into said manifold at said discharge station.

36. Apparatus for supplying an electrically conductive coating material, comprising:

at least one coating dispenser;

a discharge station connected to said at least one coating dispenser;

a filling station connected to a source of coating material, said filling station being electrically isolated from said discharge station;

a shuttle device and a pumping device which are combined to form an integral coating transfer unit, said coating transfer unit being movable to said filing station at which coating material is received within said pumping device of said coating transfer unit from said source of coating material, and said coating transfer unit thereafter being movable to said discharge station at which coating material is transferred from said pumping device of said coating transfer unit to said at least one coating dispenser.

37. The apparatus of claim 36 in which said pumping device of said coating transfer unit comprises:

a pump body having a hollow interior connectable to an inlet;

a piston head formed with an outlet, said piston head being movable within said pump body in a first direction to permit the introduction of coating material through said inlet into said hollow interior, said piston head being movable in a second direction to discharge coating material from said hollow interior through said outlet in said piston head.

38. The apparatus of claim 36 in which said pumping device of coating transfer unit comprises:

a pump body having a hollow interior;

a piston head movable within said hollow interior and slidable along a piston rod having an inlet and an outlet;

said piston head being movable in a first direction to permit the introduction of coating material through said inlet of said piston rod into said hollow interior, said piston head being movable in a second direction to discharge coating material from said hollow interior through said outlet in said piston rod.

39. The apparatus of claim 36 in which said shuttle device of said coating transfer unit includes:

a fluid cylinder having a piston rod connected to a portion of said shuttle device, said piston rod being extendable and retractable to move said coating transfer unit between said discharge station and said filling station;

guide rods extending between said discharge station and said filling station, said shuttle device being movably mounted to said guide rods.

* * * * *